US011699370B2

(12) United States Patent
Cheon et al.

(10) Patent No.: US 11,699,370 B2
(45) Date of Patent: Jul. 11, 2023

(54) DISPLAY DEVICE HAVING EDGE DETERMINER AND SUBPIXEL RENDERER AND METHOD OF DRIVING THE SAME

(71) Applicant: Samsung Display Co., Ltd., Yongin-si (KR)

(72) Inventors: Woo-Young Cheon, Suwon-si (KR); Soyoung Kwon, Seoul (KR); Jaeun Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/837,782

(22) Filed: Jun. 10, 2022

(65) Prior Publication Data

US 2023/0084121 A1 Mar. 16, 2023

(30) Foreign Application Priority Data

Sep. 10, 2021 (KR) ..... 10-2021-0120969

(51) Int. Cl.
*G09G 3/00* (2006.01)

(52) U.S. Cl.
CPC ..... *G09G 3/007* (2013.01); *G09G 2300/0452* (2013.01); *G09G 2320/0257* (2013.01); *G09G 2340/0457* (2013.01)

(58) Field of Classification Search
CPC ..... G09G 3/007; G09G 2300/0452; G09G 2320/0257; G09G 2340/0457; G09G 3/2003; G09G 3/3225; G06T 7/13; H10K 59/352
See application file for complete search history.

(56) References Cited

U.S. PATENT DOCUMENTS

| | | | | |
|---|---|---|---|---|
| 10,007,968 | B2 | 6/2018 | Jo et al. | |
| 10,032,839 | B2 | 7/2018 | Kang et al. | |
| 11,238,816 | B2 | 2/2022 | Huangfu et al. | |
| 2015/0015590 | A1* | 1/2015 | Jeong | G09G 3/2003 345/502 |
| 2017/0091903 | A1* | 3/2017 | Jo | G06T 7/13 |
| 2019/0140030 | A1* | 5/2019 | Huangfu | G09G 3/3225 |
| 2021/0091145 | A1* | 3/2021 | Huangfu | H10K 59/352 |

FOREIGN PATENT DOCUMENTS

| | | |
|---|---|---|
| KR | 10-2017-0038294 | 4/2017 |
| KR | 10-2021-0005290 | 1/2021 |

* cited by examiner

*Primary Examiner* — Richard J Hong
(74) *Attorney, Agent, or Firm* — H.C. Park & Associates, PLC

(57) ABSTRACT

A display device includes a display panel and an image processor. The display panel includes pixels, each pixel among the pixels including sub-pixels. The image processor is configured to process image data for image display via the display panel. An arrangement of sub-pixels of a pixel in an odd-numbered pixel column of the display panel is different from an arrangement of sub-pixels of a pixel in an even-numbered pixel column of the display panel. The image processor includes an edge determiner and a sub-pixel renderer. The edge determiner is configured to determine an edge from the image data. The sub-pixel renderer is configured to perform sub-pixel rendering on pixel data about sub-pixels configured to display a same color in adjacent pixels in the odd-numbered pixel column or the even-numbered pixel column located at the edge.

17 Claims, 13 Drawing Sheets

DISPLAY DEVICE HAVING EDGE DETERMINER AND SUBPIXEL RENDERER AND METHOD OF DRIVING THE SAME

CROSS-REFERENCE TO RELATED APPLICATIONS

This application claims priority to and the benefit of Korean Patent Application No. 10-2021-0120969, filed Sep. 10, 2021, which is hereby incorporated by reference for all purposes as if fully set forth herein.

BACKGROUND

Field

One or more embodiments generally relate to a display device, and, more particularly, to a display device applied to various electronic apparatuses and a method of driving the display device.

Discussion

A display device may include a pixel, which is a minimum unit for displaying an image. The pixel may include sub-pixels configured to display mutually different colors. The sub-pixels may be arranged within a pixel in various schemes in consideration of luminous efficiency, display quality, and/or the like.

When a black object is displayed on a white background, or a white object is displayed on a black background, a color blur phenomenon in which a color other than white is displayed at a boundary between white and black may occur. When the color blur phenomenon occurs, display quality of the display device may deteriorate.

When a line extending in a horizontal direction, a vertical direction, a diagonal direction, or the like is displayed, a line roughness, such as a line width roughness or a line edge roughness, may be visually recognized. When the line roughness is visually recognized, the display quality of the display device may deteriorate.

The above information disclosed in this section is only for understanding the background of the inventive concepts, and, therefore, may contain information that does not form prior art.

SUMMARY

One or more embodiments provide a display device capable of preventing (or at least reducing) a color blur phenomenon and improving line roughness.

One or more embodiments provide a method of driving a display device capable of preventing (or at least reducing) a color blur phenomenon and improving line roughness.

Additional aspects will be set forth in the detailed description which follows, and, in part, will be apparent from the disclosure, or may be learned by practice of the inventive concepts.

According to an embodiment, a display device includes a display panel and an image processor. The display panel includes pixels, each pixel among the pixels including sub-pixels. The image processor is configured to process image data for image display via the display panel. An arrangement of sub-pixels of a pixel in an odd-numbered pixel column of the display panel is different from an arrangement of sub-pixels of a pixel in an even-numbered pixel column of the display panel. The image processor includes an edge determiner and a sub-pixel renderer. The edge determiner is configured to determine an edge from the image data. The sub-pixel renderer is configured to perform sub-pixel rendering on pixel data about sub-pixels configured to display a same color in adjacent pixels in the odd-numbered pixel column or the even-numbered pixel column located at the edge.

According to an embodiment, a method of driving a display device in which an arrangement of sub-pixels of a pixel in an odd-numbered pixel column is different from an arrangement of sub-pixels of a pixel in an even-numbered pixel column, includes determining an edge from image data, and performing sub-pixel rendering on pixel data about sub-pixels configured to display a same color in adjacent pixels in the odd-numbered pixel column or the even-numbered pixel column located at the edge.

According to various embodiments, an arrangement of sub-pixels of a pixel in an odd-numbered pixel column may be different from an arrangement of sub-pixels of a pixel in an even-numbered pixel column such that a color blur phenomenon may be prevented (or at least reduced) and display quality may be enhanced.

According to various embodiments, a sub-pixel rendering may be performed on pixel data about sub-pixels configured to display the same color in adjacent pixels in an odd-numbered pixel column or an even-numbered pixel column located at an edge such that line roughness may be improved and display quality may be enhanced.

The foregoing general description and the following detailed description are illustrative and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION OF SOME EMBODIMENTS

Figure 1:
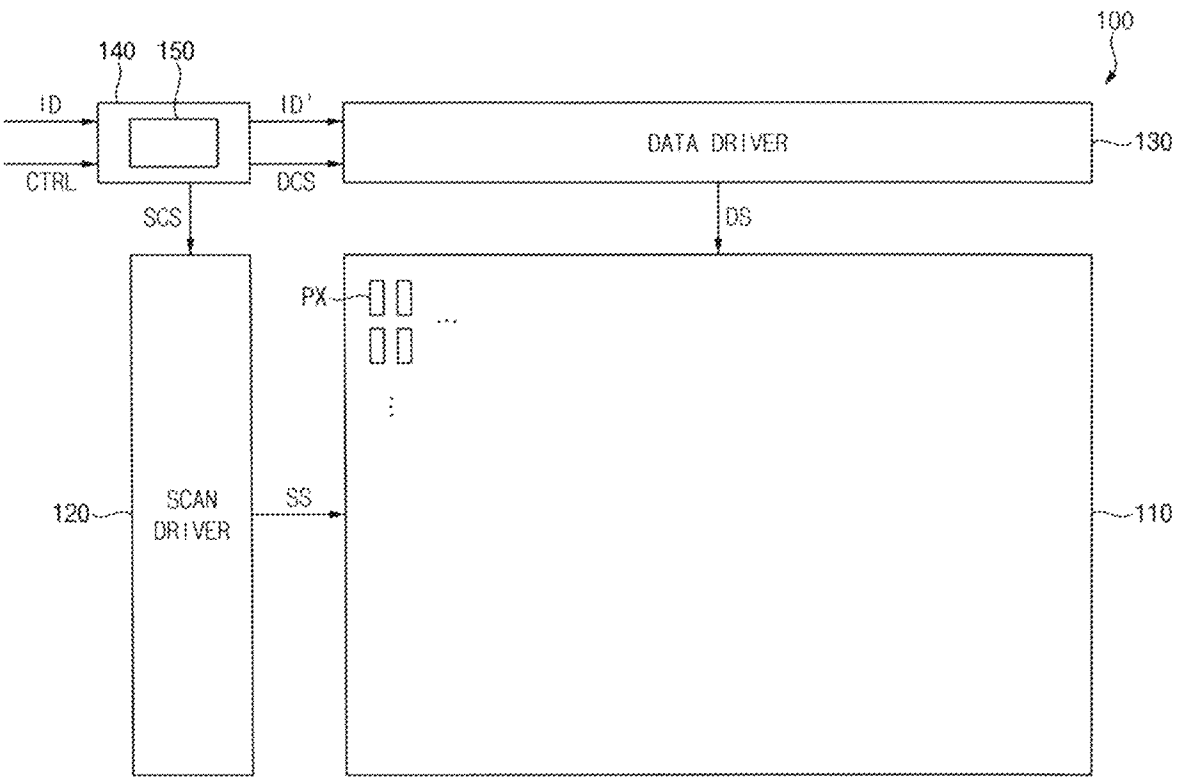
FIG. 1 is a block diagram showing a display device according to an embodiment.

In the following description, for the purposes of explanation, numerous specific details are set forth in order to provide a thorough understanding of various embodiments. As used herein, the terms "embodiments" and "implementations" may be used interchangeably and are non-limiting examples employing one or more of the inventive concepts disclosed herein. It is apparent, however, that various embodiments may be practiced without these specific details or with one or more equivalent arrangements. In other instances, well-known structures and devices are shown in block diagram form to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing example features of varying detail of some embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing some embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the inventive concepts. Further, the blocks, units, and/or modules of some embodiments may be physically combined into more complex blocks, units, and/or modules without departing from the inventive concepts.

Hereinafter, various embodiments will be explained in detail with reference to the accompanying drawings.

FIG. 1 is a block diagram showing a display device 100 according to an embodiment.

Referring to FIG. 1, a display device 100 may include a display panel 110, a scan driver 120, a data driver 130, a timing controller 140, and an image processor 150.

The display panel 110 may include a plurality of pixels PX. Each of the pixels PX may emit light based on a scan signal SS provided from the scan driver 120 and a data signal DS provided from the data driver 130. The display panel 110 may display an image based on the light emitted from the pixels PX.

Each of the pixels PX may include sub-pixels. Each of the sub-pixels may display one predetermined color. Each of the pixels PX may display various colors by combining a plurality of colors displayed by the sub-pixels.

The scan driver 120 may generate the scan signal SS based on a scan control signal SCS provided from the timing controller 140. The scan driver 120 may provide the scan signal SS to the display panel 110.

The data driver 130 may generate the data signal DS based on compensation image data ID' and a data control signal DCS provided from the timing controller 140. The data driver 130 may provide the data signal DS to the display panel 110.

The timing controller 140 may generate the compensation image data ID', the scan control signal SCS, and the data control signal DCS based on image data ID and a control signal CTRL provided from an external device. The timing controller 140 may provide the scan control signal SCS to the scan driver 120, and may provide the compensation image data ID' and the data control signal DCS to the data driver 130. Accordingly, the timing controller 140 may control driving of the scan driver 120 and the data driver 130.

The image processor 150 may process the image data ID for image display via the display panel 110. The image processor 150 may generate the compensation image data ID' based on the image data ID. The image processor 150 may determine a line roughness of an image displayed by the display panel 110, determine an edge from the image data ID, and perform sub-pixel rendering on pixel data about sub-pixels of the pixels PX located at the edge.

Although the image processor 150 has been shown in FIG. 1 as being included in the timing controller 140, embodiments are not limited thereto. For instance, the image processor 150 may be formed separately from the timing controller 140.

Figure 2:
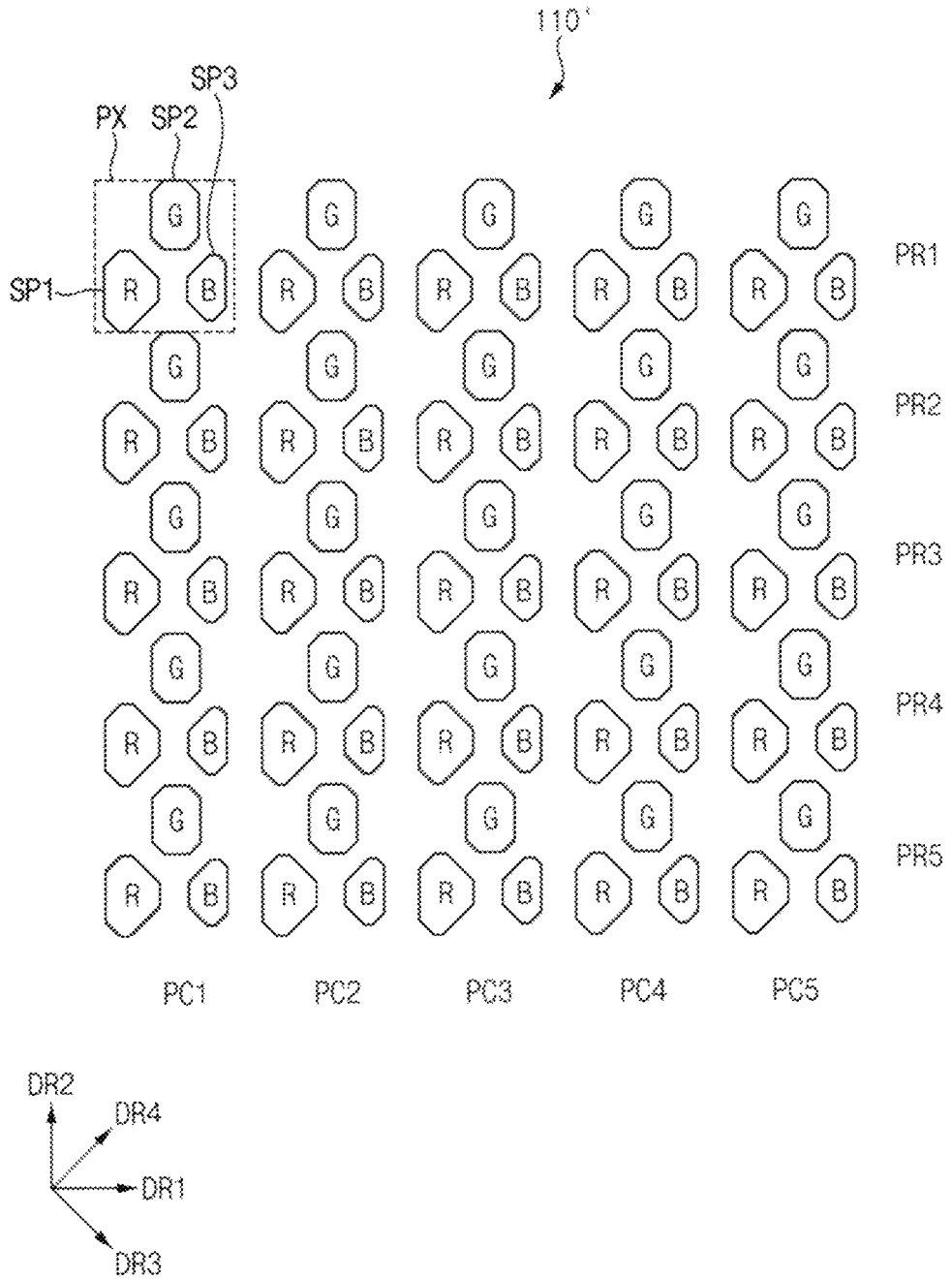
FIG. 2 is a plan view showing a comparative example of a display panel.

FIG. 2 is a plan view showing a comparative example of a display panel 110'.

Referring to FIG. 2, each of the pixels PX may include a first sub-pixel SP1, a second sub-pixel SP2, and a third sub-pixel SP3. The first sub-pixel SP1 may display a red color, the second sub-pixel SP2 may display a green color, and the third sub-pixel SP3 may display a blue color.

The second sub-pixel SP2 may be spaced apart from the first sub-pixel SP1 in a horizontal direction DR1, and may be shifted from the first sub-pixel SP1 in a vertical direction DR2. For example, the first sub-pixel SP1 and the second sub-pixel SP2 may be located on mutually different horizontal lines in one pixel PX.

The third sub-pixel SP3 may be spaced apart from the first sub-pixel SP1 in the horizontal direction DR1, and may be parallel to the first sub-pixel SP1 in the vertical direction DR2. For example, the first sub-pixel SP1 and the third sub-pixel SP3 may be located on the same horizontal line in one pixel PX.

According to the comparative example shown in FIG. 2, an arrangement of sub-pixels SP1, SP2, and SP3 of a pixel PX in odd-numbered pixel columns PC1, PC3, and PC5 may be the same as an arrangement of sub-pixels SP1, SP2, and SP3 of a pixel PX in even-numbered pixel columns PC2 and PC4. According to the comparative example, when a white object is displayed on a black background, or a black object is displayed on a white background, a color blur phenomenon in which a color other than white is displayed at a boundary between the black background and the white object or a boundary between the white background and the black object extending in the horizontal direction DR1 may occur. For example, a magenta color caused by the first sub-pixel SP1 and the third sub-pixel SP3 or a green color caused by the second sub-pixel SP2 may be displayed at the boundary between the black background and the white object or the boundary between the white background and the black object extending in the horizontal direction DR1.

Figure 3:
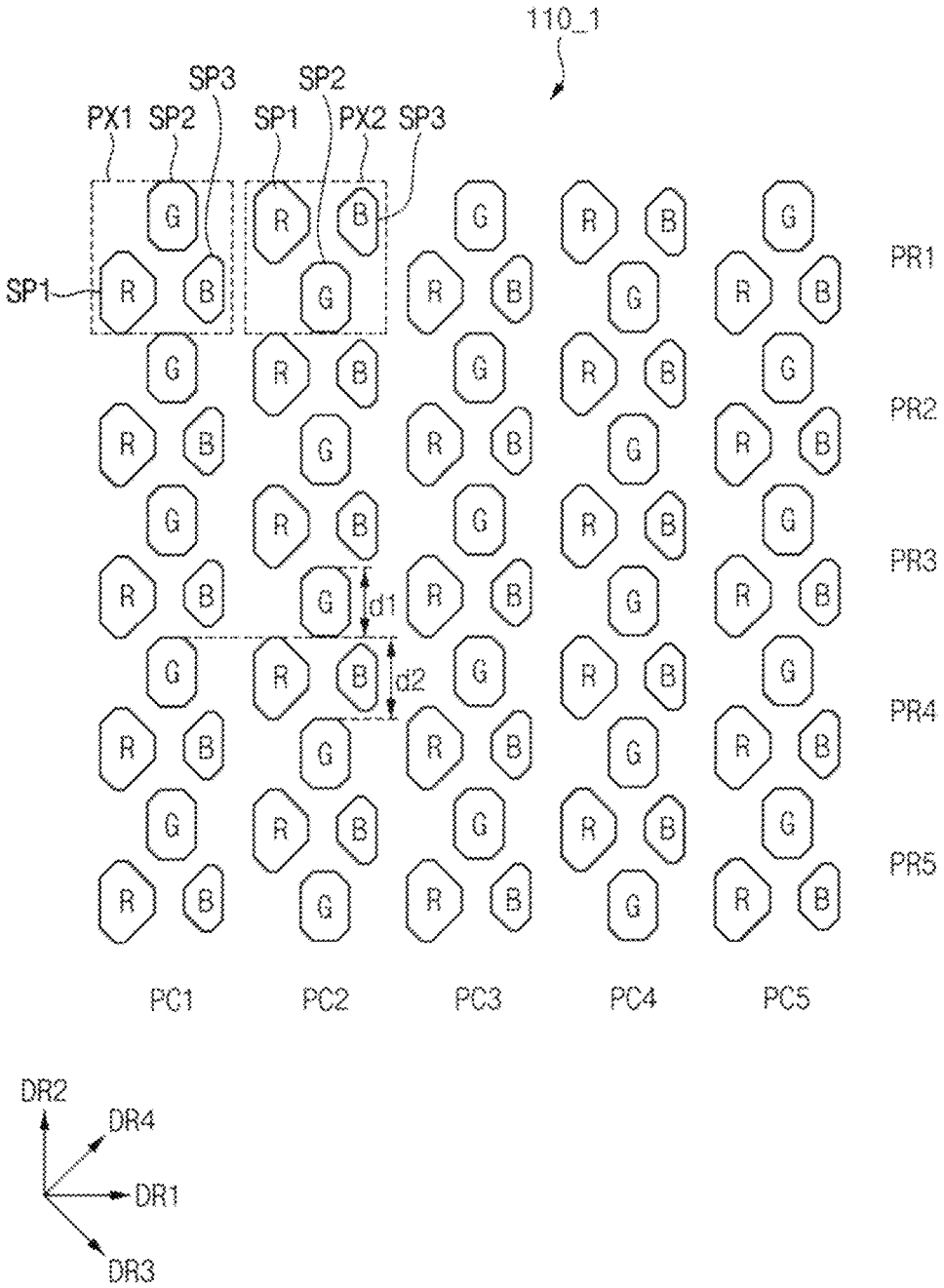
FIG. 3 is a plan view showing a display panel according to an embodiment.

FIG. 3 is a plan view showing a display panel 110_1 according to an embodiment.

With regard to a display panel 110_1 that will be described with reference to FIG. 3, descriptions of components that are substantially identical or similar to the components of the display panel 110' described with reference to FIG. 2 will be omitted.

Referring to FIG. 3, an arrangement of sub-pixels SP1, SP2, and SP3 of a first pixel PX1 in the odd-numbered pixel columns PC1, PC3, and PC5 may be different from an arrangement of sub-pixels SP1, SP2, and SP3 of a second pixel PX2 in the even-numbered pixel is columns PC2 and PC4. According to an embodiment, the arrangement of the sub-pixels SP1, SP2, and SP3 of the first pixel PX1 and the arrangement of the sub-pixels SP1, SP2, and SP3 of the second pixel PX2 may be axisymmetric with respect to the horizontal direction DR1. For example, the first pixel PX1 may be configured such that the second sub-pixel SP2 is spaced apart from the first sub-pixel SP1 in a second diagonal direction DR4 passing through a first quadrant and a third quadrant, and the third sub-pixel SP3 is spaced apart from the second sub-pixel SP2 in a first diagonal direction DR3 passing through a second quadrant and a fourth quadrant. In addition, the second pixel PX2 may be configured such that the second sub-pixel SP2 is spaced apart from the first sub-pixel SP1 in the first diagonal direction DR3, and the third sub-pixel SP3 is spaced apart from the second sub-pixel SP2 in the second diagonal direction DR4.

According to an embodiment, a second pixel PX2 in the even-numbered pixel columns PC2 and PC4 and one pixel row may be parallel to a first pixel PX1 in the odd-numbered pixel columns PC1, PC3, and PC5 and the pixel row in the vertical direction DR2. For example, the second pixel PX2 in one pixel row may be spaced apart from the first pixel PX1 in the pixel row in the horizontal direction DR1.

A distance d2 between a second sub-pixel SP2 of a first pixel PX1 in the odd-numbered pixel columns PC1, PC3, and PC5 and an $n^{th}$ pixel row (where n is a natural number) and a second sub-pixel SP2 of a second pixel PX2 in the even-numbered pixel columns PC2 and PC4 and the $n^{th}$ pixel row in the vertical direction DR2 may be greater than a distance d1 between the second sub-pixel SP2 of the first pixel PX1 in the odd-numbered pixel columns PC1, PC3, and PC5 and the $n^{th}$ pixel row and a second sub-pixel SP2 of a second pixel PX2 in the even-numbered pixel columns PC2 and PC4 and an $(n-1)^{th}$ pixel row in the vertical direction DR2. In other words, the distance d2 between the second sub-pixel SP2 of the first pixel PX1 and the second sub-pixel SP2 of the second pixel PX2 disposed in the same pixel row in the vertical direction DR2 may be greater than the distance d1 between the second sub-pixel SP2 of the first pixel PX1 and the second sub-pixel SP2 of the second pixel PX2 disposed in adjacent pixel rows in the vertical direction DR2.

Figure 4:
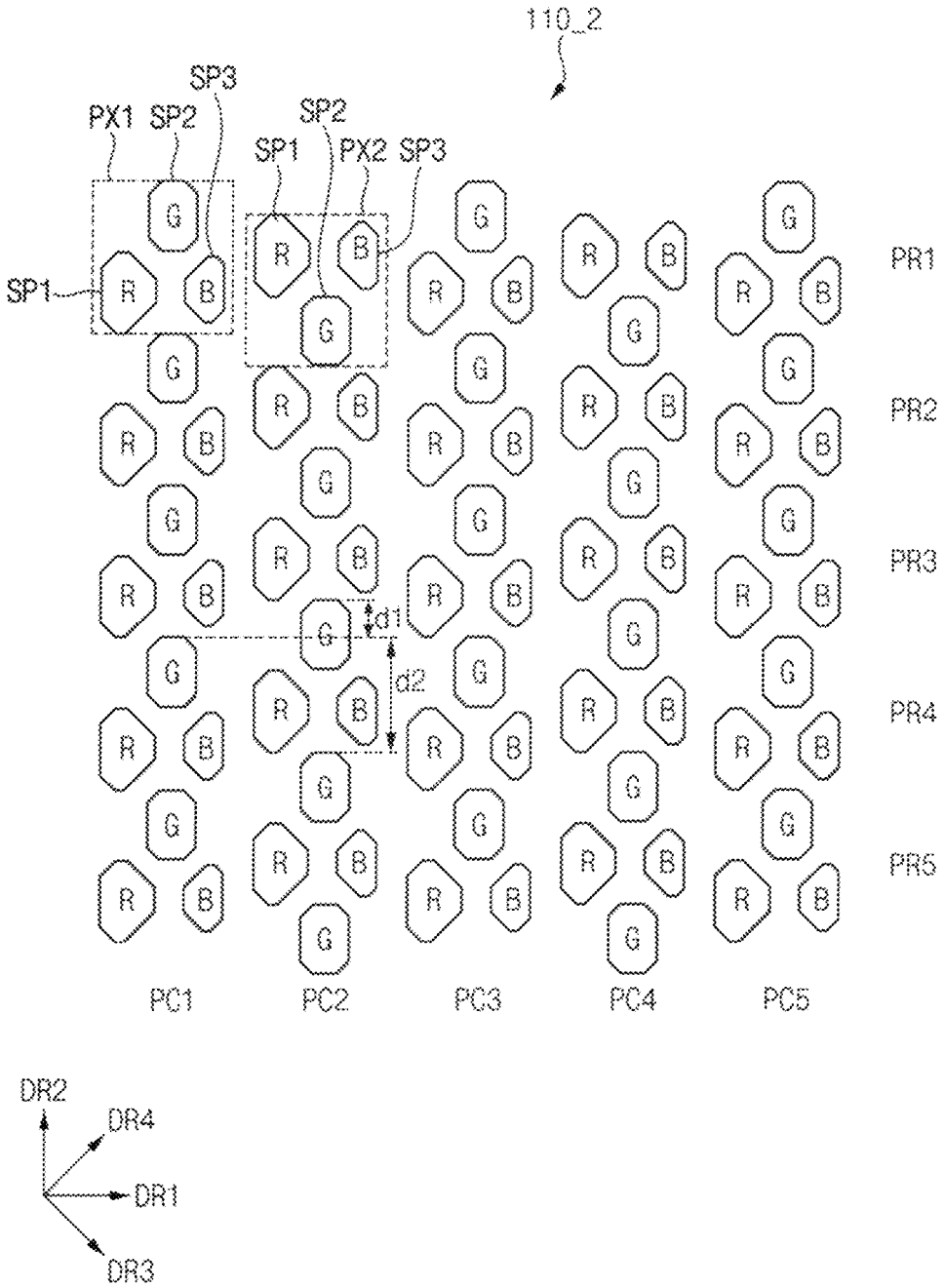
FIG. 4 is a plan view showing a display panel according to an embodiment.

FIG. 4 is a plan view showing a display panel 110_2 according to an embodiment.

With regard to a display panel 110_2 that will be described with reference to FIG. 4, descriptions of components that are substantially identical or similar to the components of the display panel 110_1 described with reference to FIG. 3 will be omitted.

Referring to FIG. 4, according to an embodiment, a second pixel PX2 in the even-numbered pixel columns PC2 and PC4 and one pixel row may be shifted in the vertical direction D2 from a first pixel PX1 in the odd-numbered pixel columns PC1, PC3, and PC5 and the pixel row. For example, the second pixel PX2 in one pixel row may be spaced apart from the first pixel PX1 in the pixel row in the first diagonal direction DR3 or the second diagonal direction DR4.

A distance d1 between a second sub-pixel SP2 of a first pixel PX1 and a second sub-pixel SP2 of a second pixel PX2 disposed in adjacent pixel rows in the vertical direction DR2 when the second pixel PX2 in the even-numbered pixel columns PC2 and PC4 and one pixel row is shifted from the first pixel PX1 in the odd-numbered pixel columns PC1, PC3, and PC5 and the pixel row in the vertical direction DR2 as shown in FIG. 4 may be smaller than the distance d1 between the second sub-pixel SP2 of the first pixel PX1 and the second sub-pixel SP2 of the second pixel PX2 disposed in the adjacent pixel rows in the vertical direction DR2 when the second pixel PX2 in the even-numbered pixel columns PC2 and PC4 and one pixel row is parallel to the first pixel PX1 in the odd-numbered pixel columns PC1, PC3, and PC5 and the pixel row in is the vertical direction DR2 (e.g., the second pixel PX2 in the even-numbered pixel columns PC2 and PC4 and one pixel row is not shifted from the first pixel PX1 in the odd-numbered pixel columns PC1, PC3, and PC5 and the pixel row in the vertical direction DR2) as shown in FIG. 3.

According to various embodiments described in association with FIGS. 3 and 4, since the arrangement of the sub-pixels SP1, SP2, and SP3 of the first pixel PX1 in the odd-numbered pixel columns PC1, PC3, and PC5 is different from the arrangement of the sub-pixels SP1, SP2, and SP3 of the second pixel PX2 in the even-numbered pixel columns PC2 and PC4, the color blur phenomenon may be reduced or substantially prevented at the boundary between the black background and the white object or the boundary between the white background and the black object extending in the horizontal direction DR1.

When the pixels PX1 and PX2 located in one pixel row display colors to display an edge of an object extending in the horizontal direction DR1, since the distance d2 between the second sub-pixel SP2 of the first pixel PX1 and the second sub-pixel SP2 of the second pixel PX2 disposed in the same pixel row in the vertical direction DR2 is greater than the distance d1 between the second sub-pixel SP2 of the first pixel PX1 and the second sub-pixel SP2 of the second pixel PX2 disposed in the adjacent pixel rows in the vertical direction DR2, a roughness (line roughness) of the edge extending in the horizontal direction DR1 may be increased. As such, sub-pixel rendering may be utilized for pixel data about sub-pixels SP1, SP2, and SP3 of the pixels PX1 and PX2 located at the edge. For example, since a luminance of the second sub-pixel SP2 may be greater than a luminance of each of the first and third sub-pixels SP1 and SP3, the sub-pixel rendering may be used for pixel data about the second sub-pixels SP2 of the pixels PX1 and PX2 located at the edge.

Figure 5:
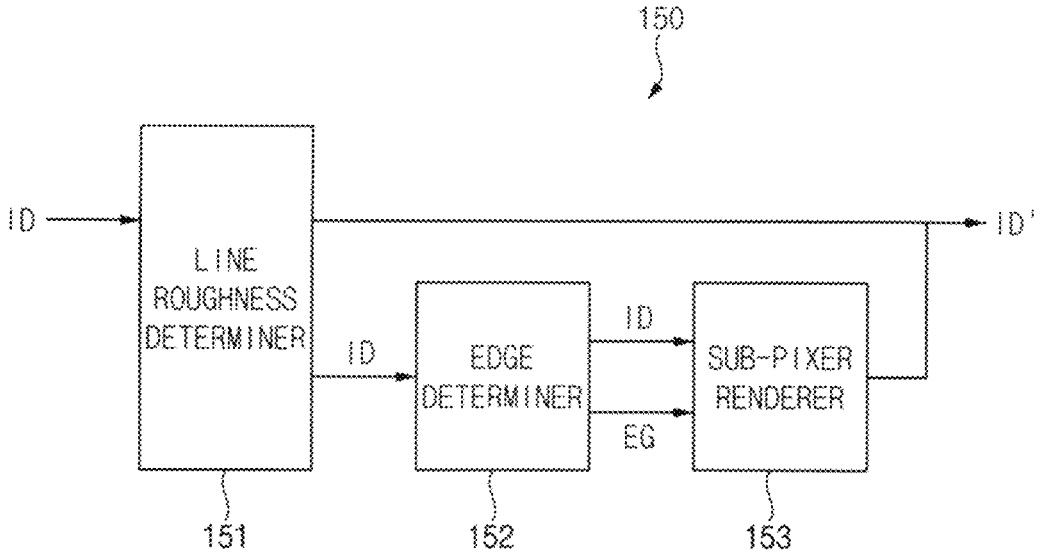
FIG. 5 is a block diagram showing an image processor according to an embodiment.

FIG. 5 is a block diagram showing an image processor 150 according to an is embodiment.

Referring to FIG. 5, the image processor 150 may include a line roughness determiner 151, an edge determiner 152, and a sub-pixel renderer 153.

The line roughness determiner 151 may determine a line roughness based on a pixel pitch in the vertical direction DR2 and a distance between sub-pixels SP1, SP2, and SP3 of a first pixel PX1 in the odd-numbered pixel columns PC1, PC3, and PC5 and sub-pixels SP1, SP2, and SP3 of a second pixel PX2 in the even-numbered pixel columns PC2 and PC4, which are configured to display the same color in one pixel row, in the vertical direction DR2. The determination of the line roughness will be described in more detail with reference to FIG. 9.

When the line roughness is less than a reference value, the image processor 150 may not compensate for the image data ID. In this case, the compensation image data ID' output from the image processor 150 may be the same as the image data ID.

When the line roughness is greater than the reference value, the edge determiner 152 may determine an edge EG of an object from the image data ID. For example, when a white object is displayed on a black background, the edge determiner 152 may determine an edge EG of the white object from the image data ID. According to an embodiment, a direction of the edge EG may be determined as one of the horizontal direction DR1, the first diagonal direction DR3, and the second diagonal direction DR4.

The sub-pixel renderer 153 may perform the sub-pixel rendering on pixel data about sub-pixels SP1, SP2, and SP3 configured to display the same color in adjacent pixels PX1 and PX2 in the odd-numbered pixel columns PC1, PC3 and PC5 or the even-numbered pixel columns PC2 and PC4 located at the edge EG. According to an embodiment, the sub-pixel renderer 153 may perform the sub-pixel rendering on pixel data about sub-pixels SP1, SP2, and SP3 configured to display the same color in adjacent first pixels PX1 in the odd-numbered pixel columns PC1, PC3, and PC5 located at the edge EG. According to another embodiment, the sub-pixel renderer 153 may perform the sub-pixel rendering on pixel data about sub-pixels SP1, SP2, and SP3 configured to display the same color in adjacent second pixels PX2 in the even-numbered pixel columns PC2 and PC4 located at the edge EG.

According to an embodiment, the sub-pixel renderer 153 may perform the sub-pixel rendering on pixel data about second sub-pixels SP2 of the adjacent pixels PX1 and PX2 in the odd-numbered pixel columns PC1, PC3, and PC5 or the even-numbered pixel columns PC2 and PC4 located at the edge EG, but embodiments are not limited thereto.

According to another embodiment, the sub-pixel renderer 153 may perform the sub-pixel rendering on pixel data about first sub-pixels SP1 and/or third sub-pixels SP3 of the adjacent pixels PX1 and PX2 in the odd-numbered pixel columns PC1, PC3, and PC5 and/or the even-numbered pixel columns PC2 and PC4 located at the edge EG.

When the edge EG extends in the horizontal direction DR1, the sub-pixel renderer 153 may render pixel data about sub-pixels SP1, SP2, and SP3 of a pixel PX in an $(n+2k)^{th}$ pixel column (where n is a natural number, and k is an integer that is greater than or equal to 0) and an $m^{th}$ pixel row (where m is a natural number) located at the edge EG to pixel data about sub-pixels SP1, SP2, and SP3 of a pixel PX in the $(n+2k)^{th}$ pixel column and an $(m-1)^{th}$ pixel row located at the edge EG.

Figure 6A:
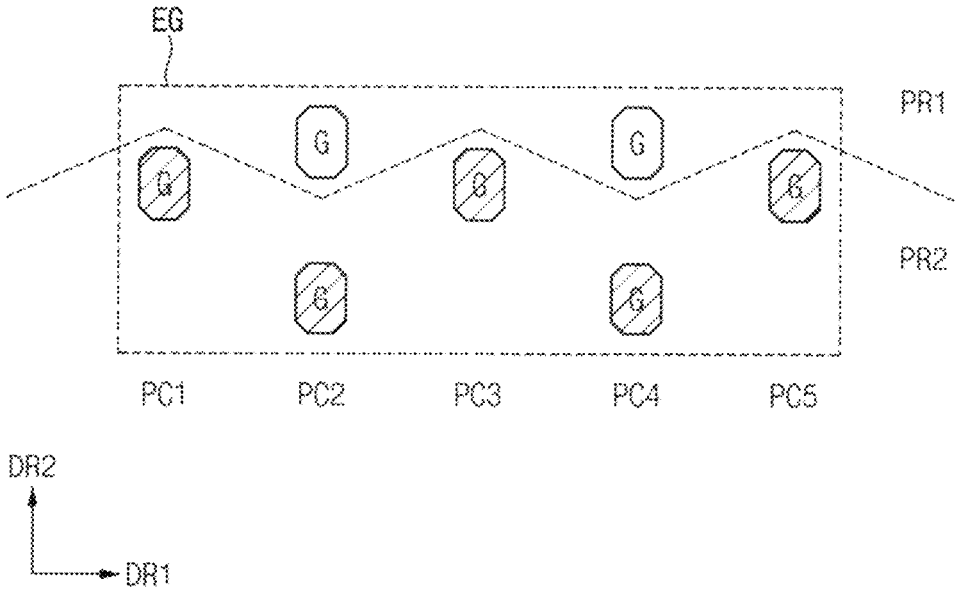
FIGS. 6A and 6B are views for describing sub-pixel rendering in a horizontal direction according to some embodiments.
Figure 6B:
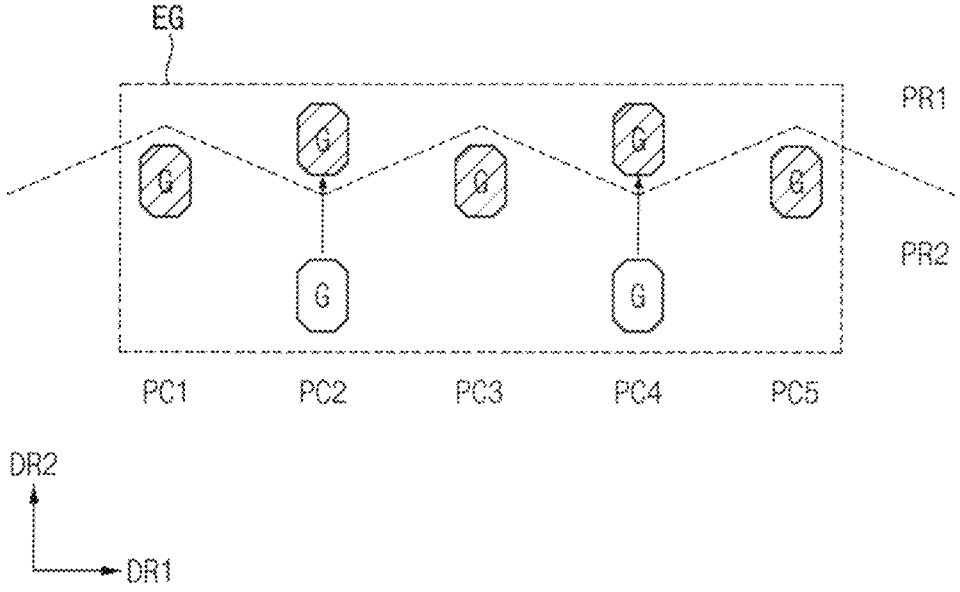

FIGS. 6A and 6B are views for describing sub-pixel rendering in a horizontal direction DR1 according to some embodiments. For instance, FIG. 6A may be a view showing a state before the sub-pixel rendering in the horizontal direction DR1, and FIG. 6B may be a view showing a state after the sub-pixel rendering in the horizontal direction DR1.

Referring to FIGS. 6A and 6B, according to an embodiment, the sub-pixel renderer 153 may render pixel data about the second sub-pixel SP2 of the pixel PX in the $(n+2k)^{th}$ pixel column and the $m^{th}$ pixel row located at the edge EG to pixel data about the second sub-pixel SP2 of the pixel PX in the $(n+2k)^{th}$ pixel column and the $(m-1)^{th}$ pixel row located at the edge EG. For example, the sub-pixel renderer 153 may render pixel data about the second sub-pixel SP2 of the second pixel PX2 in a second pixel column PC2 and a second pixel row PR2 located at the edge EG to pixel data about the second sub-pixel SP2 of the second pixel PX2 in the second pixel column PC2 and a first pixel row PR1 located at the edge EG, and may render pixel data about the second sub-pixel SP2 of the second pixel PX2 in a fourth pixel column PC4 and the second pixel row PR2 located at the edge EG to pixel data about the second sub-pixel SP2 of the second pixel PX2 in the fourth pixel column PC4 and the first pixel row PR1 located at the edge EG.

When the object is displayed without the sub-pixel rendering in the horizontal direction DR1, the distance between the second sub-pixel SP2 of the first pixel PX1 in the odd-numbered pixel columns PC1, PC3, and PC5 and the second sub-pixels SP2 of the second pixel PX2 in the even-numbered pixel columns PC2 and PC4 located in the same pixel row PR2 in the vertical direction DR2 is relatively large such that the line roughness of the edge EG extending in the horizontal direction DR1 may be increased. However, according to an embodiment, when the object is displayed after performing the sub-pixel rendering in the horizontal direction DR1, the distance between the second sub-pixel SP2 of the first pixel PX1 in the odd-numbered pixel columns PC1, PC3, and PC5 located in the second pixel row PR2 and the second sub-pixel SP2 of the second pixel PX2 in the even-numbered pixel columns PC2 and PC4 located in the first pixel row PR1 in the vertical direction DR2 is relatively small such that the line roughness of the edge EG extending in the horizontal direction DR1 may be reduced. Therefore, display quality of the display device 100 for the edge EG extending in the horizontal direction DR1 may be improved.

When the edge EG extends in the first diagonal direction DR3, the sub-pixel renderer 153 may render pixel data about sub-pixels SP1, SP2, and SP3 of a pixel PX in an $(n+2k)^{th}$ pixel column (where n is a natural number, and k is an integer that is greater than or equal to 0) and an $(m+2k)^{th}$ pixel row (where m is a natural number) located at the edge EG to pixel data about sub-pixels SP1, SP2, and SP3 of a pixel PX in the $(n+2k)^{th}$ pixel column and an $(m+2k-1)^{th}$ pixel row located at the edge EG.

Figure 7A:
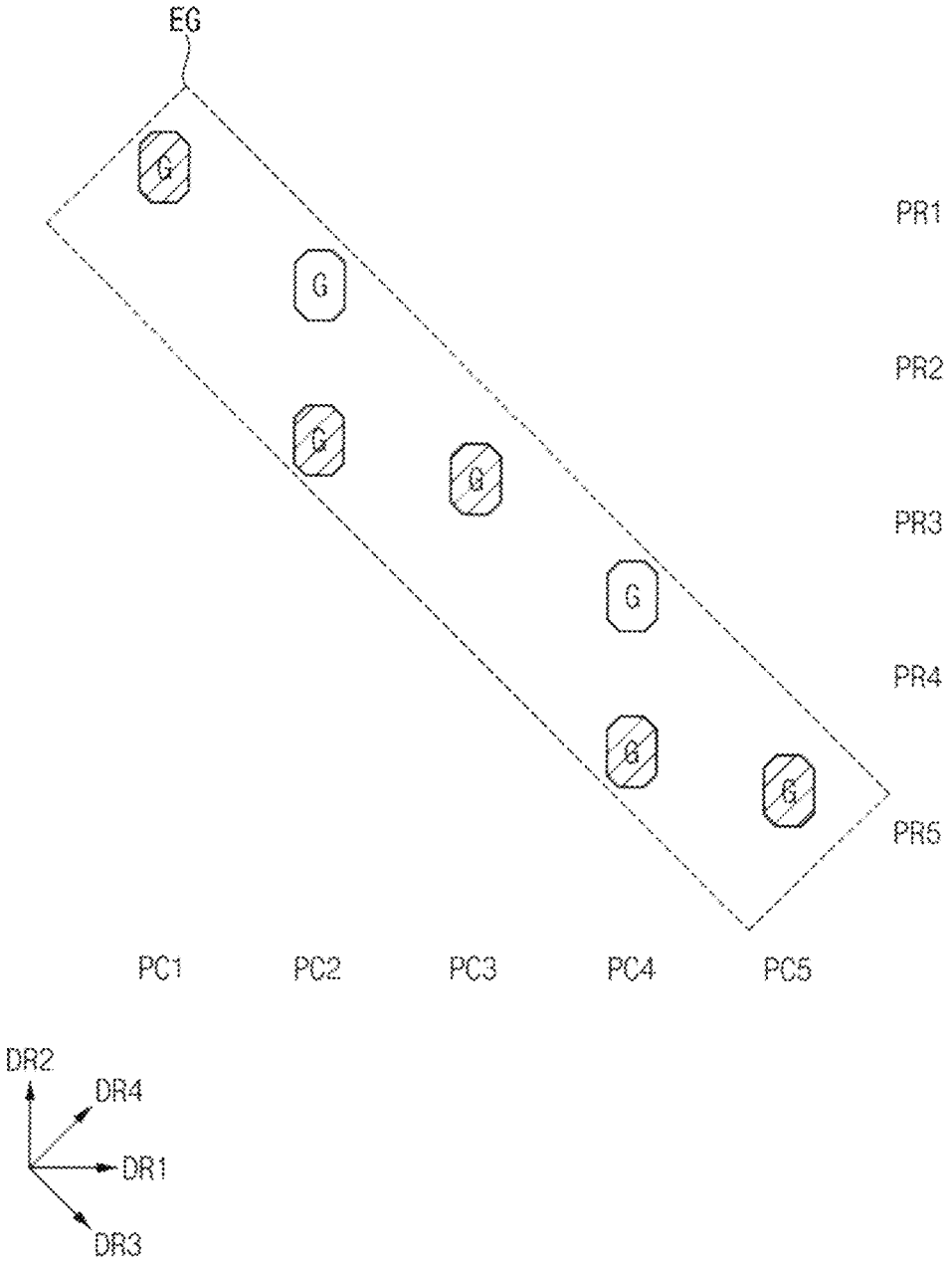
FIGS. 7A and 7B are views for describing sub-pixel rendering in a first diagonal direction according to some embodiments.
Figure 7B:
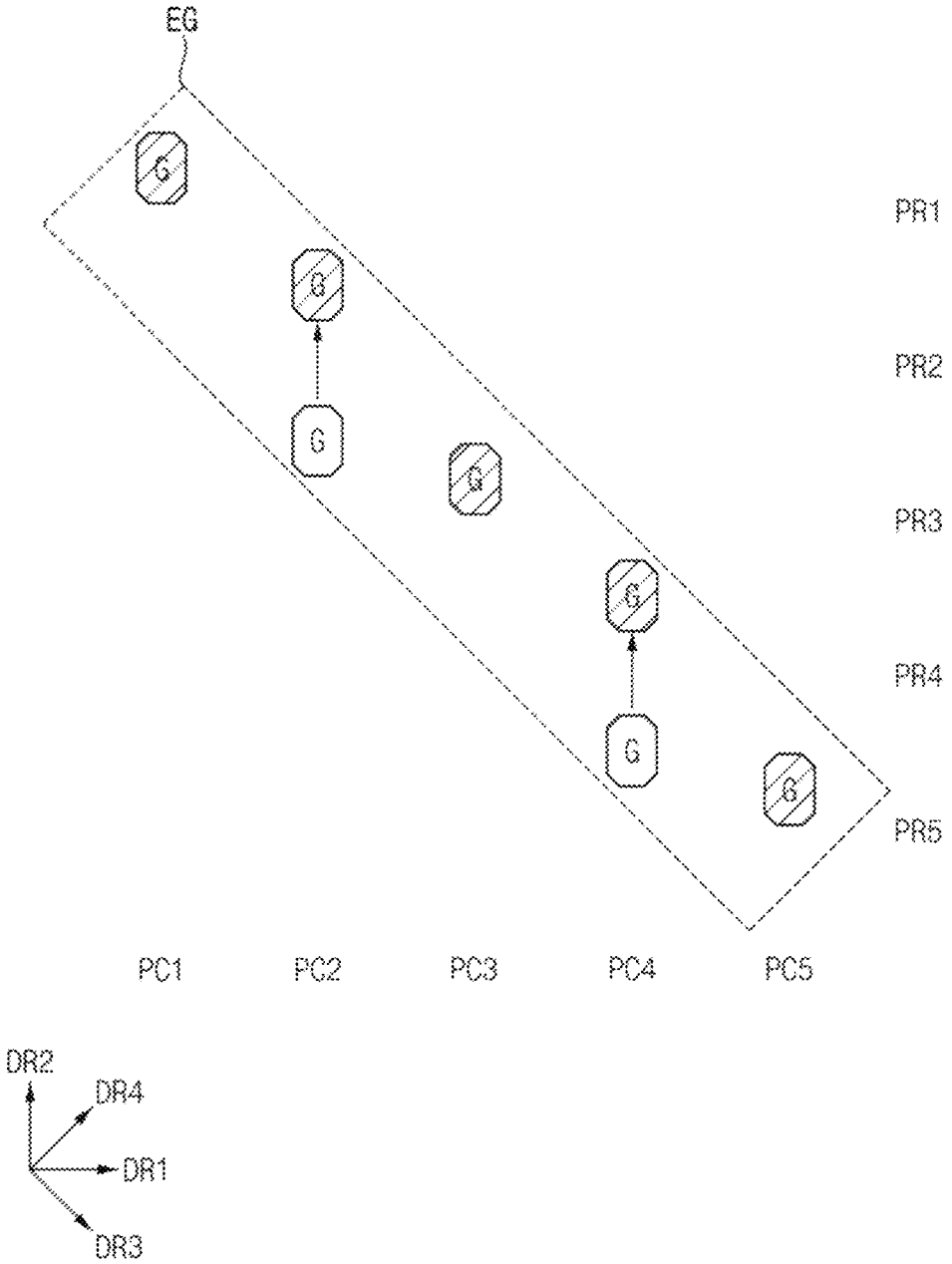

FIGS. 7A and 7B are views for describing sub-pixel rendering in a first diagonal direction DR3 according to some embodiments. For example, FIG. 7A may be a view showing a state before the sub-pixel rendering in the first diagonal direction DR3, and FIG. 7B may be a view showing a state after the sub-pixel rendering in the first diagonal direction DR3.

Referring to FIGS. 7A and 7B, according to an embodiment, the sub-pixel renderer 153 may render pixel data about the second sub-pixel SP2 of the pixel PX in the $(n+2k)^{th}$ pixel column and the $(m+2k)^{th}$ pixel row located at the edge EG to pixel data about the second sub-pixel SP2 of the pixel PX in the $(n+2k)^{th}$ pixel column and the $(m+2k-1)^{th}$ pixel row located at the edge EG. For example, the sub-pixel renderer 153 may render pixel data about the second sub-pixel SP2 of the second pixel PX2 in the second pixel column PC2 and the second pixel row PR2 located at the edge EG to pixel data about the second sub-pixel SP2 of the second pixel PX2 in the second pixel column PC2 and the first pixel row PR1 located at the edge EG, and may render pixel data about the second sub-pixel SP2 of the second pixel PX2 in the fourth pixel column PC4 and a fourth pixel row PR4 located at the edge EG to pixel data about the second sub-pixel SP2 of the second pixel PX2 in the fourth pixel column PC4 and a third pixel row PR3 located at the edge EG.

According to various embodiments, when the object is displayed after performing is the sub-pixel rendering in the first diagonal direction DR3, the distance between the second sub-pixels SP2 configured to display the image at the edge EG in the second diagonal direction DR4 is relatively small such that the line roughness of the edge EG extending in the first diagonal direction DR3 may be reduced. Therefore, display quality of the display device 100 for the edge EG extending in the first diagonal direction DR3 may be improved.

When the edge EG extends in the second diagonal direction DR4, the sub-pixel renderer 153 may render pixel data about sub-pixels SP1, SP2, and SP3 of a pixel PX in an $(n+2k)^{th}$ pixel column (where n is a natural number, and k is an integer that is greater than or equal to 0) and an $(m-2k)^{th}$ pixel row (where m is a natural number) located at the edge EG to pixel data about sub-pixels SP1, SP2, and SP3 of a pixel PX in the $(n+2k)^{th}$ pixel column and an $(m-2k-1)^{th}$ pixel row located at the edge EG.

Figure 8A:
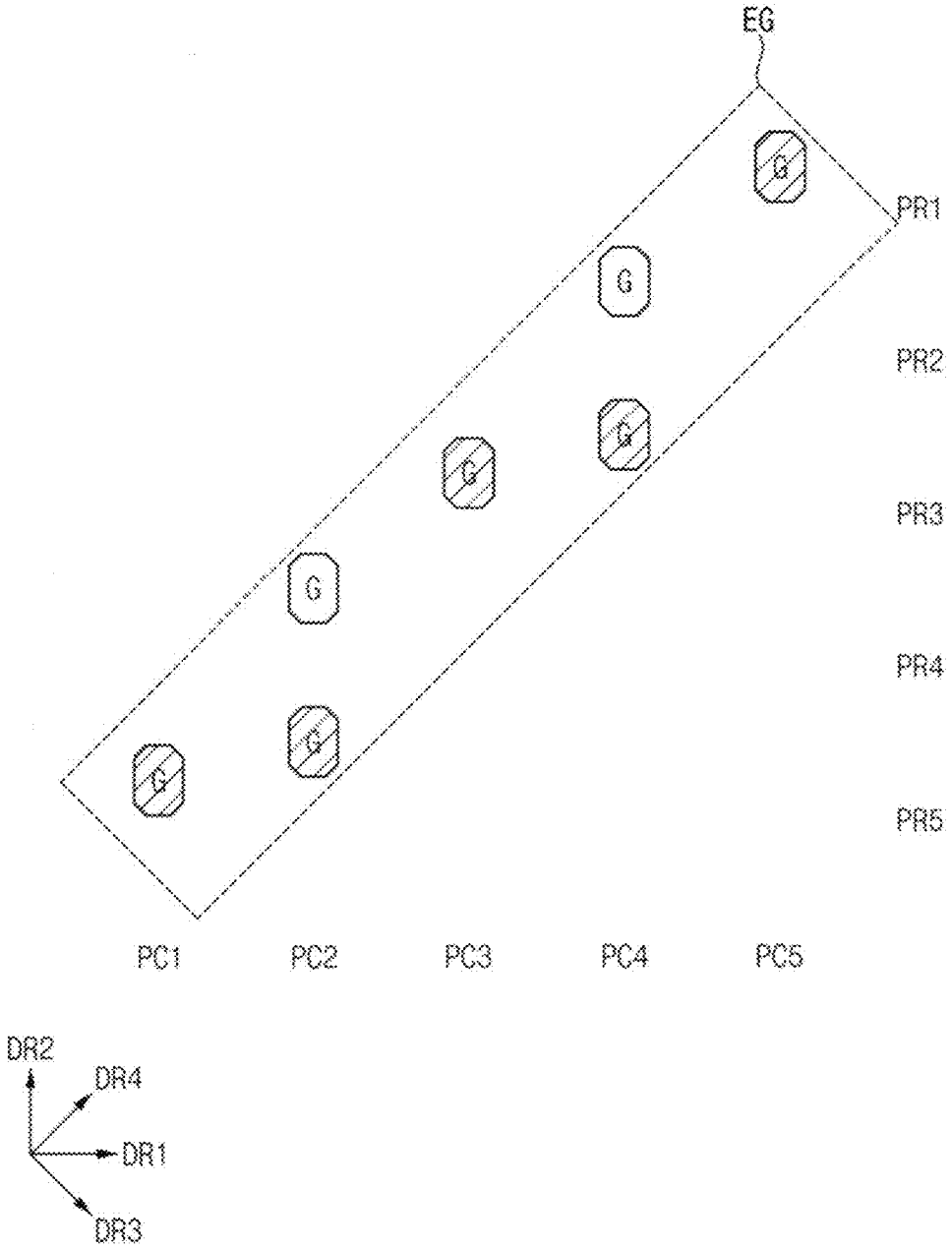
FIGS. 8A and 8B are views for describing sub-pixel rendering in a second diagonal direction according to some embodiments.
Figure 8B:
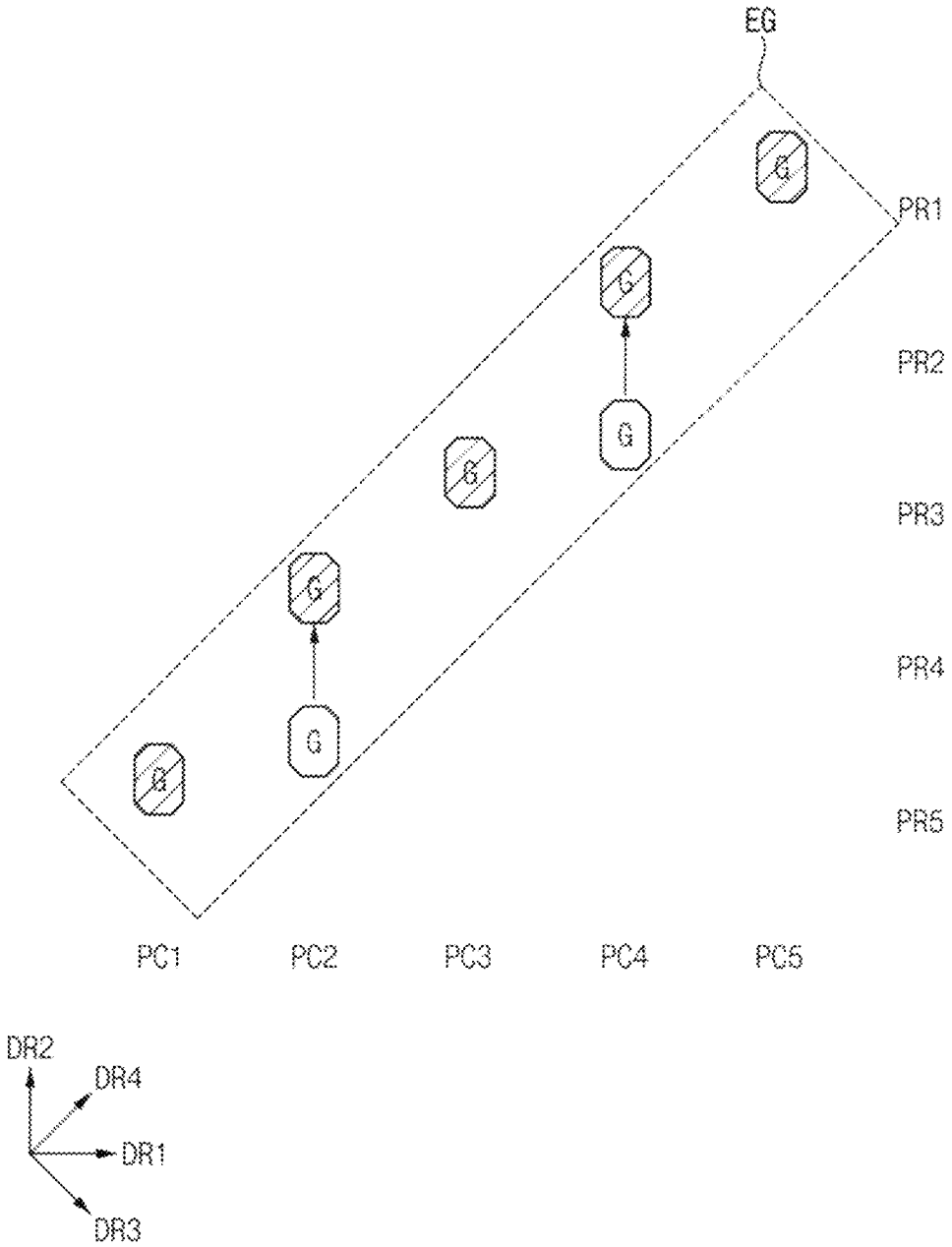

FIGS. 8A and 8B are views for describing sub-pixel rendering in a second diagonal direction DR4 according to some embodiments. For instance, FIG. 8A may be a view showing a state before the sub-pixel rendering in the second diagonal direction DR4, and FIG. 8B may be a view showing a state after the sub-pixel rendering in the second diagonal direction DR4.

Referring to FIGS. 8A and 8B, according to an embodiment, the sub-pixel renderer 153 may render pixel data about the second sub-pixel SP2 of the pixel PX in the $(n+2k)^{th}$ pixel column and the $(m-2k)^{th}$ pixel row located at the edge EG to pixel data about the second sub-pixel SP2 of the pixel PX in the $(n+2k)^{th}$ pixel column and the $(m-2k-1)^{th}$ pixel row located at the edge EG. For example, the sub-pixel renderer 153 may render pixel data about the second sub-pixel SP2 of the second pixel PX2 in the second pixel column PC2 and the fourth pixel row PR4 located at the edge EG to pixel data about the second sub-pixel SP2 of the second pixel PX2 in the second pixel column PC2 and the third pixel row PR3 located at the edge EG, and may render pixel data is about the second sub-pixel SP2 of the second pixel PX2 in the fourth pixel column PC4 and the second pixel row PR2 located at the edge EG to pixel data about the second sub-pixel SP2 of the second pixel PX2 in the fourth pixel column PC4 and the first pixel row PR1 located at the edge EG.

According to various embodiments, when the object is displayed after performing the sub-pixel rendering in the second diagonal direction DR4, the distance between the second sub-pixels SP2 configured to display the image at the edge EG in the first diagonal direction DR3 is relatively small such that the line roughness of the edge EG extending in the second diagonal direction DR4 may be reduced. Therefore, display quality of the display device 100 for the edge EG extending in the second diagonal direction DR4 may be improved.

Figure 9:
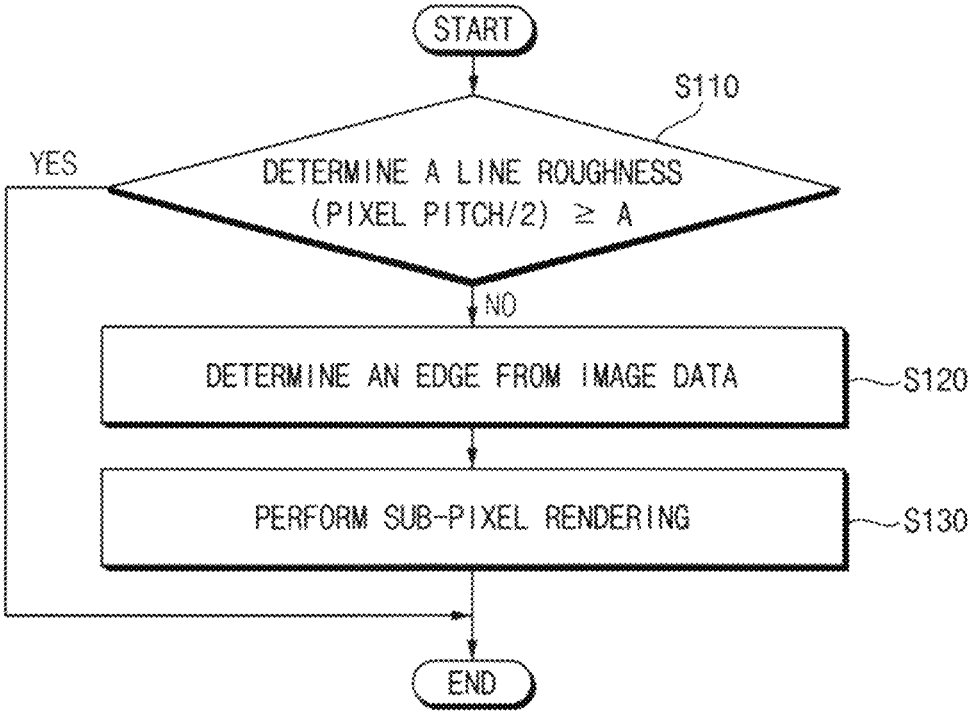
FIG. 9 is a flowchart showing a method of driving a display device according to an embodiment.

FIG. 9 is a flowchart showing a method of driving a display device 100 according to an embodiment.

Referring to FIG. 9, a line roughness determiner 151 of an image processor 150 may determine a line roughness based on a pixel pitch in the vertical direction DR2 and a distance a between sub-pixels SP1, SP2, and SP3 of a first pixel PX1 in odd-numbered pixel columns PC1, PC3, and PC5 and sub-pixels SP1, SP2, and SP3 of a second pixel PX2 in even-numbered pixel columns PC2 and PC4, which are configured to display the same color in one pixel row, in the vertical direction DR2 (S110). The pixel pitch in the vertical direction DR2 may be a length of the pixels PX1 and PX2 in the vertical direction DR2. The pixel pitch in the vertical direction DR2 may be derived by dividing a length of a pixel area of a display panel 110 in the vertical direction DR2 by a number of pixel rows.

According to an embodiment, the line roughness determiner 151 may determine the line roughness by comparing a half of the pixel pitch in the vertical direction DR2 with the is distance a between the sub-pixels SP1, SP2, and SP3 of the first pixel PX1 in the odd-numbered pixel columns PC1, PC3, and PC5 and the sub-pixels SP1, SP2, and SP3 of the second pixel PX2 in the even-numbered pixel columns PC2 and PC4, which are configured to display the same color in one pixel row, in the vertical direction DR2.

As shown in FIG. 2, when the half of the pixel pitch in the vertical direction DR2 is greater than or equal to the distance a between the sub-pixels SP1, SP2, and SP3 of the pixel PX in the odd-numbered pixel columns PC1, PC3, and PC5 and the sub-pixels SP1, SP2, and SP3 of the pixel PX in the even-numbered pixel columns PC2 and PC4, which are configured to display the same color in one pixel row, in the vertical direction DR2, determining of an edge (S120) and performing of sub-pixel rendering (S130), which will be described below, may be omitted. In this case, the line roughness may be relatively small such that the sub-pixel rendering may not be required for the pixel data about the sub-pixels SP1, SP2, and SP3 of the pixels PX located at the edge EG. Accordingly, the image processor 150 may not compensate for the image data ID.

As shown in FIGS. 3 and 4, an edge determiner 152 of the image processor 150 may determine an edge EG of an object from image data ID when a half of the pixel pitch in the vertical direction DR2 is smaller than a distance d2 between the sub-pixels SP1, SP2, and SP3 of the first pixel PX1 in the odd-numbered pixel columns PC1, PC3, and PC5 and the sub-pixels SP1, SP2, SP3 of the second pixel PX2 in the even-numbered pixel columns PC2 and PC4, which are configured to display the same color in one pixel row, in the vertical direction DR2 (S120). For example, when a white object is displayed on a black background, the edge determiner 152 may determine an edge EG of the white object from the image data ID. In an embodiment, a direction of the edge EG may be determined as one of the horizontal direction DR1, the first diagonal direction DR3, and the second diagonal direction DR4.

A sub-pixel renderer 153 of the image processor 150 may perform sub-pixel rendering on pixel data about sub-pixels SP1, SP2, and SP3 configured to display the same color in adjacent pixels PX1 and PX2 in the odd-numbered pixel columns PC1, PC3 and PC5 or the even-numbered pixel columns PC2 and PC4 located at the edge EG. According to an embodiment, the sub-pixel renderer 153 may perform the sub-pixel rendering on pixel data about sub-pixels SP1, SP2, and SP3 configured to display the same color in adjacent first pixels PX1 in the odd-numbered pixel columns PC1, PC3, and PC5 located at the edge EG. According to another embodiment, the sub-pixel renderer 153 may perform the sub-pixel rendering on pixel data about sub-pixels SP1, SP2, and SP3 configured to display the same color in adjacent second pixels PX2 of the even-numbered pixel columns PC2 and PC4 located at the edge EG.

According to an embodiment, the sub-pixel renderer 153 may perform the sub-pixel rendering on pixel data about second sub-pixels SP2 of the adjacent pixels PX1 and PX2 in the odd-numbered pixel columns PC1, PC3, and PC5 or the even-numbered pixel columns PC2 and PC4 located at the edge EG, but embodiments are not limited thereto. According to another embodiment, the sub-pixel renderer 153 may perform the sub-pixel rendering on pixel data about first sub-pixels SP1 and/or third sub-pixels SP3 of the adjacent pixels PX1 and PX2 in the odd-numbered pixel columns PC1, PC3, and PC5 or the even-numbered pixel columns PC2 and PC4 located at the edge EG.

When the edge EG extends in the horizontal direction DR1, the sub-pixel renderer 153 may render pixel data about sub-pixels SP1, SP2, and SP3 of a pixel PX in an $(n+2k)^{th}$ pixel column (where n is a natural number, and k is an integer that is greater than or equal to 0) and an $m^{th}$ pixel row (where m is a natural number) located at the edge EG to pixel data about sub-pixels SP1, SP2, and SP3 of a pixel PX in the $(n+2k)^{th}$ pixel column and an $(m-1)^{th}$ pixel row located at is the edge EG.

When the edge EG extends in the first diagonal direction DR3, the sub-pixel renderer 153 may render pixel data about sub-pixels SP1, SP2, and SP3 of a pixel PX in an $(n+2k)^{th}$ pixel column (where n is a natural number, and k is an integer that is greater than or equal to 0) and an $(m+2k)^{th}$ pixel row (where m is a natural number) located at the edge EG to pixel data about sub-pixels SP1, SP2, and SP3 of a pixel PX in the $(n+2k)^{th}$ pixel column and an $(m+2k-1)^{th}$ pixel row located at the edge EG.

When the edge EG extends in the second diagonal direction DR4, the sub-pixel renderer 153 may render pixel data about sub-pixels SP1, SP2, and SP3 of a pixel PX in an $(n+2k)^{th}$ pixel column (where n is a natural number, and k is an integer that is greater than or equal to 0) and an $(m-2k)^{th}$ pixel row (where m is a natural number) located at the edge EG to pixel data about sub-pixels SP1, SP2, and SP3 of a pixel PX in the $(n+2k)^{th}$ pixel column and an $(m-2k-1)^{th}$ pixel row located at the edge EG.

Figure 10A:
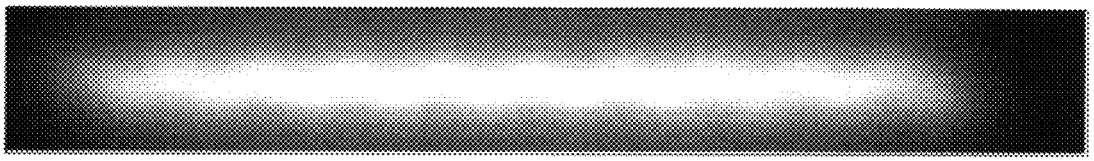
FIGS. 10A and 10B are views showing line roughness before and after sub-pixel rendering according to some embodiments.
Figure 10B:
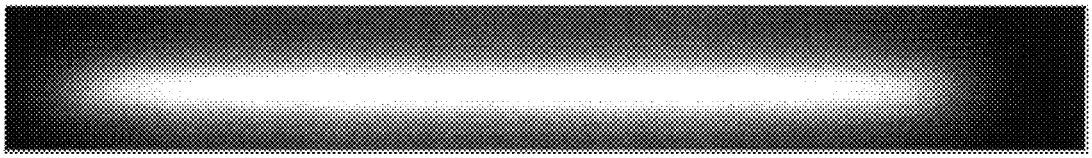

FIGS. 10A and 10B are views showing line roughness before and after the sub-pixel rendering according to some embodiments. For example, FIG. 10A may show a line displayed in one pixel row before the sub-pixel rendering in the horizontal direction DR1, and FIG. 10B may show a line displayed in one pixel row after the sub-pixel rendering in the horizontal direction DR1.

Referring to FIGS. 10A and 10B, when a line extending in the horizontal direction DR1 is displayed before the sub-pixel rendering, the distance between the second sub-pixel SP2 of the first pixel PX1 in the odd-numbered pixel columns PC1, PC3, and PC5 and the second sub-pixels SP2 of the second pixel PX2 in the even-numbered pixel columns PC2 and PC4 located in the same pixel row PR2 in the vertical direction DR2 is relatively large such that a roughness of is the line extending in the horizontal direction DR1 may be increased. However, according to an embodiment, when the line extending in the horizontal direction DR1 is displayed after performing the sub-pixel rendering, the distance between the second sub-pixel SP2 of the first pixel PX1 in the odd-numbered pixel columns PC1, PC3, and PC5 located in the second pixel row PR2 and the second sub-pixel SP2 of the second pixel PX2 in the even-numbered pixel columns PC2 and PC4 located in the first pixel row PR1 in the vertical direction DR2 is relatively small such that the roughness of the line extending in the horizontal direction DR1 may be reduced. Therefore, display quality of the display device 100 for the line extending in the horizontal direction DR1 may be improved.

Figure 11:
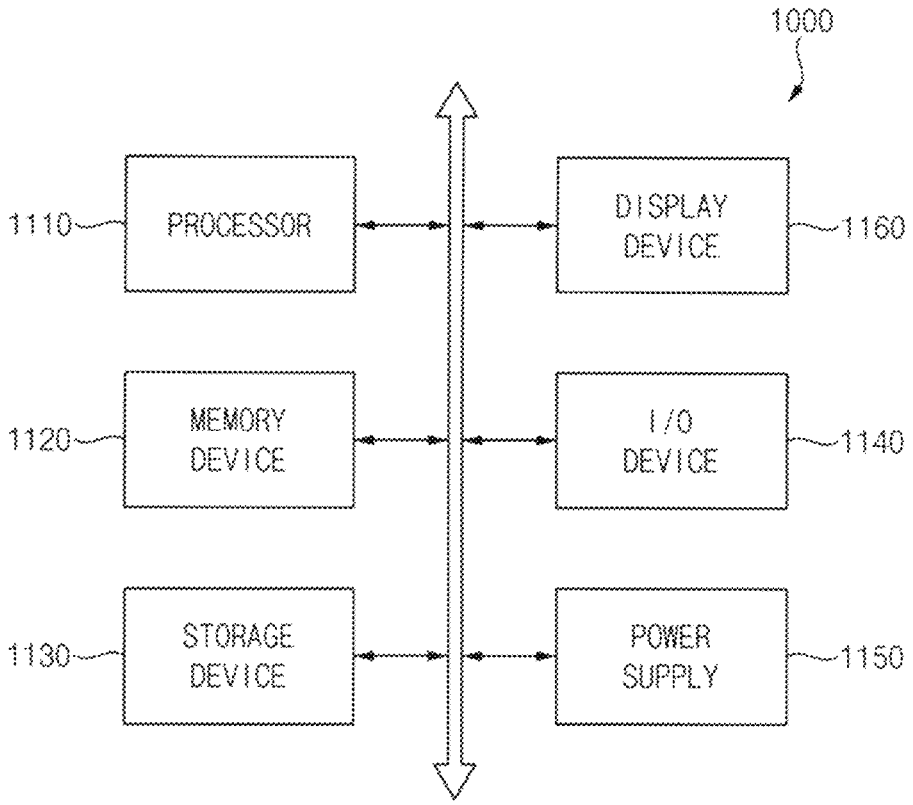
FIG. 11 is a block diagram showing an electronic device including a display device according to an embodiment.

FIG. 11 is a block diagram showing an electronic device 1100 including a display device 1160 according to an embodiment.

Referring to FIG. 11, an electronic device 1100 may include a processor 1110, a memory device 1120, a storage device 1130, an input/output (I/O) device 1140, a power supply 1150, and a display device 1160. The electronic device 1100 may further include various ports capable of communicating with a video card, a sound card, a memory card, a universal serial bus (USB) device, and/or the like, or communicating with other systems.

The processor 1110 may perform specific calculations or tasks. According to an embodiment, the processor 1110 may be a microprocessor, a central processing unit (CPU), or the like. The processor 1110 may be connected to other components through an address bus, a control bus, a data bus, or the like. According to an embodiment, the processor 1110 may also be connected to an expansion bus, such as a peripheral component interconnect (PCI) bus.

The memory device 1120 may store data for an operation of the electronic device 1100. For example, the memory device 1120 may include a non-volatile memory device, such as is an erasable programmable read-only memory (EPROM), an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), and a ferroelectric random access memory (FRAM), and/or a volatile memory device, such as a dynamic random access memory (DRAM), a static random access memory (SRAM), and a mobile DRAM.

The storage device 1130 may include a solid-state drive (SSD), a hard disk drive (HDD), a compact disk (CD)-ROM, and/or the like. The I/O device 1140 may include an input device, such as a keyboard, a keypad, a touch pad, a touch screen, and/or a mouse, and an output device, such as a speaker, a printer, etc. The power supply 1150 may supply a power for the operation of the electronic device 1100. The display device 1160 may be connected to other components through the buses or other communication links.

Since a display panel included in the display device 1160 is configured such that an arrangement of sub-pixels of a pixel in an odd-numbered pixel column is different from an arrangement of sub-pixels of a pixel in an even-numbered pixel column, a color blur phenomenon may be prevented or at least mitigated, and display quality of the display device 1160 may be improved. In addition, since an image processor included in the display device 1160 performs sub-pixel rendering on pixel data about sub-pixels configured to display the same color in adjacent pixels in the odd-numbered pixel column or the even-numbered pixel column located at an edge, a line roughness may be improved, and the display quality of the display device 1160 may be improved.

A display device according to one or more embodiments may be applied to a display device included in (or associated with) a personal computer, a notebook computer, a mobile phone, a smartphone, a smart pad, a portable media player (PMP), a personal digital assistant (PDA), an MP3 player, or the like.

Although certain embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A display device comprising:

a display panel comprising pixels, each pixel among the pixels comprising sub-pixels; and an image processor configured to process image data for image display via the display panel, wherein an arrangement of sub-pixels of a pixel in an odd-numbered pixel column of the display panel is different from an arrangement of sub-pixels of a pixel in an even-numbered pixel column of the display panel such that a pixel in the even-numbered pixel column and one pixel row of the display panel is shifted from a pixel in the odd-numbered pixel column and the pixel row in a vertical direction, and wherein the image processor comprises:

an edge determiner configured to determine an edge from the image data; and a sub-pixel renderer configured to perform sub-pixel rendering on pixel data about sub-pixels configured to display a same color in adjacent pixels in the odd-numbered pixel column or the even-numbered pixel column located at the edge.

2. The display device of claim 1, wherein each pixel among the pixels comprises:

a first sub-pixel configured to display a red color;

a second sub-pixel configured to display a green color; and a third sub-pixel configured to display a blue color.

3. The display device of claim 2, wherein the sub-pixel renderer is configured to perform the sub-pixel rendering on pixel data about second sub-pixels of the adjacent pixels in the odd-numbered pixel column or the even-numbered pixel column located at the edge.

4. The display device of claim 2, wherein:

the second sub-pixel is shifted from the first sub-pixel in a vertical direction; and the third sub-pixel is parallel to the first sub-pixel in the vertical direction.

5. The display device of claim 2, wherein a distance between a second sub-pixel of a pixel in the odd-numbered pixel column and an $n^{th}$ pixel row (where n is a natural number) and a second sub-pixel of a pixel in the even-numbered pixel column and the $n^{th}$ pixel row in a vertical direction is greater than a distance between the second sub-pixel of the pixel in the odd-numbered pixel column and the $n^{th}$ pixel row and a second sub-pixel of a pixel in the even-numbered pixel column and an $(n-1)^{th}$ pixel row in the vertical direction.

6. The display device of claim 1, wherein the arrangement of the sub-pixels of the pixel in the odd-numbered pixel column and the arrangement of the sub-pixels of the pixel in the even-numbered pixel column are axisymmetric with respect to a horizontal direction.

7. The display device of claim 1, wherein:

the edge extends in a horizontal direction; and the sub-pixel renderer is configured to render pixel data about a sub-pixel of a pixel in an $(n+2k)^{th}$ pixel column (where n is a natural number, and k is an integer that is greater than or equal to 0) and an $m^{th}$ pixel row (where m is a natural number) located at the edge to pixel data about a sub-pixel of a pixel in the $(n+2k)^{th}$ pixel column and an $(m-1)^{th}$ pixel row located at the edge.

8. The display device of claim 1, wherein:

the edge extends in a diagonal direction passing through a second quadrant and a fourth quadrant; and the sub-pixel renderer is configured to render pixel data about a sub-pixel of a pixel in an $(n+2k)^{th}$ pixel column (where n is a natural number, and k is an integer that is greater than or equal to 0) and an $(m+2k)^{th}$ pixel row (where m is a natural number) located at the edge to pixel data about a sub-pixel of a pixel in the $(n+2k)^{th}$ pixel column and an $(m+2k-1)^{th}$ pixel row located at the edge.

9. The display device of claim 1, wherein:

the edge extends in a diagonal direction passing through a first quadrant and a third quadrant; and the sub-pixel renderer is configured to render pixel data about a sub-pixel of a pixel in an $(n+2k)^{th}$ pixel column (where n is a natural number, and k is an integer that is greater than or equal to 0) and an $(m-2k)^{th}$ pixel row (where m is a natural number) located at the edge to pixel data about a sub-pixel of a pixel in the $(n+2k)^{th}$ pixel column and an $(m-2k-1)^{th}$ pixel row located at the edge.

10. A method of driving a display device in which an arrangement of sub-pixels of a pixel in an odd-numbered pixel column is different from an arrangement of sub-pixels of a pixel in an even-numbered pixel column, the method comprising:

determining a line roughness based on a pixel pitch in a vertical direction and a distance between a sub-pixel of a pixel in the odd-numbered pixel column and a sub-pixel of a pixel in the even-numbered pixel column that are configured to display the same color in one pixel row, in the vertical direction, determining an edge from image data; and performing sub-pixel rendering on pixel data about sub-pixels configured to display a same color in adjacent pixels in the odd-numbered pixel column or the even-numbered pixel column located at the edge.

11. The method of claim 10, wherein, in response to a half of the pixel pitch being greater than or equal to the distance, performance of the sub-pixel rendering is omitted.

12. The method of claim 10, wherein the arrangement of the sub-pixels of the pixel in the odd-numbered pixel column and the arrangement of the sub-pixels of the pixel in the even-numbered pixel column are axisymmetric with respect to a horizontal direction.

13. The method of claim 10, wherein a pixel in the even-numbered pixel column and one pixel row of the display device is parallel to a pixel in the odd-numbered pixel column and the pixel row in a vertical direction.

14. The method of claim 10, wherein a pixel in the even-numbered pixel column and one pixel row of the display device is shifted from a pixel in the odd-numbered pixel column and the pixel row in a vertical direction.

15. The method of claim 10, wherein, in response to the edge extending in a horizontal direction, performance of the sub-pixel rendering comprises rendering pixel data about a sub-pixel of a pixel in an $(n+2k)^{th}$ pixel column (where n is a natural number, and k is an integer that is greater than or equal to 0) and an $m^{th}$ pixel row (where m is a natural number) located at the edge to pixel data about a sub-pixel of a pixel in the $(n+2k)^{th}$ pixel column and an $(m-1)^{th}$ pixel row located at the edge.

16. The method of claim 10, wherein, in response to the edge extending in a diagonal direction passing through a second quadrant and a fourth quadrant, performance of the sub-pixel rendering comprises rendering pixel data about a sub-pixel of a pixel in an $(n+2k)^{th}$ pixel column (where n is a natural number, and k is an integer that is greater than or equal to 0) and an $(m+2k)^{th}$ pixel row (where m is a natural number) located at the edge to pixel data about a sub-pixel of a pixel in the $(n+2k)^{th}$ pixel column and an $(m+2k-1)^{th}$ pixel row located at the edge.

17. The method of claim 10, wherein, in response to the edge extending in a diagonal direction passing through a first quadrant and a third quadrant, performance of the sub-pixel rendering comprises rendering pixel data about a sub-pixel of a pixel in an $(n+2k)^{th}$ pixel column (where n is a natural number, and k is an integer that is greater than or equal to 0) and an $(m-2k)^{th}$ pixel row (where m is a natural number) located at the edge to pixel data about a sub-pixel of a pixel in the $(n+2k)^{th}$ pixel column and an $(m-2k-1)^{th}$ pixel row located at the edge.

* * * * *